US005491970A

United States Patent [19]

Davis, Jr. et al.

[11] Patent Number: 5,491,970

[45] Date of Patent: Feb. 20, 1996

[54] METHOD FOR STAGING FUEL IN A TURBINE BETWEEN DIFFUSION AND PREMIXED OPERATIONS

[75] Inventors: Lewis B. Davis, Jr., Schenectady; David O. Fitts, Ballston Spa; Warren J. Mick, Altamont; Michael B. Sciocchetti, Schenectady; Mitchell R. Cohen, Troy, all of N.Y.

[73] Assignee: General Electric Co., Schenectady, N.Y.

[21] Appl. No.: 258,112

[22] Filed: Jun. 10, 1994

[51] Int. Cl.[6] ..... F02C 7/26

[52] U.S. Cl. ..... 60/39.06

[58] Field of Search ..... 60/39.06, 39.141, 60/742, 746, 733, 737, 748

[56] References Cited

U.S. PATENT DOCUMENTS

| | | | |
|---|---|---|---|
| 3,134,224 | 5/1964 | Lippincott . | |
| 4,027,473 | 6/1977 | Baker | 60/243 |
| 4,337,616 | 7/1982 | Downing | 60/746 |
| 4,630,548 | 8/1986 | Ishibashi et al. | 60/39.06 |
| 4,683,715 | 8/1987 | Iizuka et al. | 60/733 |
| 4,720,971 | 1/1988 | Du Bell | 60/204 |
| 4,817,389 | 4/1989 | Holladay et al. | 60/739 |
| 4,897,994 | 2/1990 | Shekleton | 60/39.06 |
| 5,003,771 | 4/1991 | Kester et al. | 60/39.141 |
| 5,259,184 | 11/1993 | Borkowicz et al. | 60/39.55 |

FOREIGN PATENT DOCUMENTS 1368946 6/1964 France .

OTHER PUBLICATIONS

"Modeling Slag Deposition in the Space Shuttle Solid Rocket Motor", S. Boraas, Journal of Spacecraft and Rockets, vol. 21, No. 1, Feb. 1984, New York, pp. 47–54.

"Dry Low $No_x$ Combustion for GE Heavy–Duty Gas Turbines" brochure, L. B. Davis; GE Turbine Reference Library, General Electric Company (No Date).

*Primary Examiner*—Timothy S. Thorpe

*Attorney, Agent, or Firm*—Nixon & Vanderhye

[57] ABSTRACT

A method of operating a combustor for a turbine includes flowing fuel through a symmetrical annular array of fuel nozzles to provide an asymmetrical fuel pattern across the combustor. The asymmetrical fuel flow is provided during a diffusion mode of operation prior to transition between the diffusion mode and a premixed mode of operation, during the transition and during the premixed mode of operation. Near full power, the fuel is supplied equally among the fuel nozzles operating in the premixed mode. The asymmetric fuel flow stabilizes the combustor and inhibits high amplitude combustion noise while achieving low emission operation in the premixed mode.

16 Claims, 5 Drawing Sheets

METHOD FOR STAGING FUEL IN A TURBINE BETWEEN DIFFUSION AND PREMIXED OPERATIONS

TECHNICAL FIELD

The present invention relates to gas and liquid fueled turbines and more particularly to methods of operating combustors having multiple nozzles for use in the turbines wherein the nozzles are staged between diffusion and premixed modes of operation.

BACKGROUND

Turbines generally include a compressor section, one or more combustors, a fuel injection system and a turbine section. Typically, the compressor section pressurizes inlet air, which is then turned in a direction or reverse-flowed to the combustors, where it is used to cool the combustor and also to provide air for the combustion process. In a multi-combustor turbine, the combustors are generally located in an annular array about the turbine and a transition duct connects the outlet end of each combustor with the inlet end of the turbine section to deliver the hot products of the combustion process to the turbine.

There have been many developments in the design of combustors as a result of continuing efforts to reduce emissions, for example, $NO_x$ and CO emissions. Dual-stage combustors have been designed in the past, for example, see U.S. Pat. Nos. 4,292,801 and 4,982,570. Additionally, in U.S. Pat. No. 5,259,184, of common assignee herewith, there is disclosed a single-stage, i.e., single combustion chamber or burning zone, dual-mode (diffusion and premixed) combustor which operates in a diffusion mode at low turbine loads and in a premixed mode at high turbine loads. In that combustor, the nozzles are arranged in an annular array about the axis of the combustor and each nozzle includes a diffusion fuel section or tube so that diffusion fuel is supplied to the burning zone downstream of the nozzle and a dedicated premixing section or tube so that in the premixed mode, fuel is premixed with air prior to burning in the single combustion zone. More specifically, and in that patent, there is described diffusion/premixed fuel nozzles arranged in a circular array mounted in a combustor end cover assembly and concentric annular passages within the nozzle for supplying fuel to the nozzle tip and swirlers upstream of the tip for respective flow of fuel in diffusion and premixed modes.

It has been discovered, however, that during the transition from the diffusion mode to the premixed mode, the combustor displays a tendency to become unstable and generates high amplitude combustion noise. Additionally, as air flow and fuel flow are varied to the combustor as required by the turbine's operating cycle, the combustor's stability and noise level can be adversely affected. The consequence of a combustor with insufficient stability is the limited turndown of the combustor. The consequences of a combustor with unacceptably high noise levels are premature wear or high cycle fatigue cracking of structural components in the combustor. To design a dry low $NO_x$ combustor, it will be appreciated that $NO_x$ emissions, CO emissions, combustion dynamics and combustion stability are factors which must be considered from an aerodynamic standpoint. The nature of the combustion process provides an interdependency of these factors.

In the combustor design disclosed in U.S. Pat. No. 5,259,184, previously discussed, fuel transfer from diffusion mode to premixed mode is effected simultaneously. That is, the fuel is transferred from all diffusion nozzles simultaneously to all premixed nozzles. To accomplish that, the fuel transfer is made by simply redirecting fuel from the diffusion supply manifold to the premixed supply manifold. While the fuel nozzle end cover was internally manifolded with a fuel supply flange feeding an internal manifold for four of five premix nozzles and a fuel supply flange feeding an internal manifold for the fifth premix nozzle, the manifold arrangement was provided only in order to cope with a generator trip event while operating in a premixed mode. All premix nozzles were intended to flow equal rates of fuel into the combustor. Thus, combustion stability and combustion dynamics created certain difficulties in using this single-stage type combustor, particularly during transition from the diffusion mode to the premixed mode.

DISCLOSURE OF THE INVENTION

The present invention utilizes staging of fuel to the fuel nozzles in the turbine combustor such that stable and quiet fuel transfers from the diffusion mode of operation to the premixed mode of operation in a dry low $NO_x$ combustion system can be accomplished. The present invention also affords stable and quiet operation of the combustor while operating in the premixed mode of operation over a wider load range of the turbine than had been previously possible. To accomplish the foregoing, the supply of fuel during transition from the diffusion mode to the premixed mode is staged, as well as during steady state operation in the premixed mode. Fundamentally, the present invention provides for the variable control of the flow of fuel through the nozzles to the combustion zone downstream of the nozzles to provide an asymmetric flow of fuel across the combustor during the transition and during portions of the premixed mode of operation. That is, the present invention affords an imbalance of fuel across the combustor, i.e., an uneven flow of fuel through the nozzles in an annular array whereby the fuel/air ratio among the nozzles is different from one another. This occurs during both the diffusion mode of operation at the initiation of the transition, during transition and during premixed mode of operation at less than full power. By splitting the fuel unevenly between premix nozzles, premix nozzles designed for low $NO_x$ and CO emissions performance but which exhibit less than desirable stability and combustion dynamics characteristics can be utilized. By increasing the percentage of premixed fuel to one or more premix nozzles during transition from diffusion to premixed mode of operation and/or during steady state operation in a premixed mode, the local equivalence ratio at the one or more fuel nozzle exits is higher than at the exit of the remaining nozzles, resulting in a more stable flame at the one or more nozzles. This creates an asymmetric heat release in the head end of the combustor, which inhibits the onset of strong dynamic pressure oscillations in the combustor. Once established in steady state premixed mode, the fuel split can be equalized among the premixed nozzles, thus improving $NO_x$ and CO emissions.

In a typical example of the present invention, the combustor may have, for example, five nozzles arranged in an annular array about the central axis of the combustor similarly as disclosed in U.S. Pat. No. 5,259,184. Each nozzle is operated in a diffusion mode and supplied with fuel from a common manifold. Each nozzle is also supplied with fuel from a premix fuel supply manifold, the fuel supply to four of the premix nozzles being made through a single premix fuel supply manifold and the supply of fuel to a fifth premix nozzle being made through a second premix fuel supply manifold. As explained earlier, the two premix supply manifolds were provided to cope with a generator trip event while operating in the premixed mode and were intended to flow equal flow rates of gas fuel to the various premixed nozzles.

In accordance with the present invention, however, the fuel is staged to the various nozzles during transition from the diffusion to the premixed mode. For example, at start-up, fuel is supplied from the diffusion manifold to up to four of the five nozzles for operation in the diffusion mode, thus affording an asymmetric fuel pattern along the combustor. Fuel may also be supplied to the fifth nozzle in the diffusion mode from the same diffusion manifold, if desired, providing a symmetrical fuel flow along the combustor. During the application of load, however, the fifth nozzle is disconnected from the flow of fuel from the diffusion manifold (or is not supplied with any fuel at all from the diffusion fuel manifold upon start-up) and, before transition to the premixed mode, the fifth nozzle is provided with premixed fuel from the single premix manifold. Accordingly, during start-up at low load, four nozzles are supplied with diffusion fuel and the fifth with premixed fuel, while operation of the combustor continues in the diffusion mode. The percentage of the total fuel supplied the combustion zone by the fifth nozzle is greater than the percentage of total fuel supplied by any one of the diffusion nozzles, thus affording an asymmetrical fuel loading across the combustor. At higher loadings, for example, 50 through 90%, fuel from the diffusion manifold is shut down and fuel is supplied to the four premix nozzles from the premix manifold. When effecting this transition, the fifth nozzle has a higher fuel/air ratio than any one of the remaining four nozzles. Hence, the fifth nozzle runs rich and stable and stabilizes the remaining four nozzles. This enables the turbine to enter the premixed mode (lower emissions mode) at a lower turbine load than would otherwise be available absent this asymmetrical fuel loading. At full load, the fuel split among the various nozzles in the premix mode is equal. Thus, by unequally fuelling the nozzles during the transition and during premix operation, severe combustion dynamics, i.e., high acoustical noise and resonation, is prevented from occurring as a result of the imbalance of fuel across the combustor.

In a preferred embodiment according to the present invention, there is provided a method of operating a combustor for a gas turbine wherein the combustor has a plurality of fuel nozzles, comprising the step of variably controlling the flow of fuel through the nozzles to a combustion zone downstream of the nozzles to provide an asymmetric flow of fuel across the combustor.

In a further preferred embodiment according to the present invention, there is provided a method of operating a combustor for a gas turbine wherein the combustor has a plurality of fuel nozzles in an annular array about the combustor comprising the step of providing an asymmetric flow of fuel across the combustor to a combustion zone downstream of the nozzles.

In a still further preferred embodiment according to the present invention, there is provided a method of operating a combustor for a gas turbine wherein the combustor has a plurality of nozzles comprising the steps of flowing fuel through at least certain of the plurality of nozzles operating in a diffusion mode to a single combustion zone downstream of the nozzles and during transition from a diffusion mode of operation to a premixed mode of operation, flowing fuel to the combustion zone through at least one of the plurality of nozzles operating in a premixed mode while maintaining the certain nozzles operating in the diffusion mode.

Accordingly, it is a primary object of the present invention to provide in combustors for turbines a method of staging fuel to the fuel nozzles of the combustor for quiet and stable fuel transfer from the diffusion mode of operation to the premixed mode of operation and also to enable stable and quiet operation of the combustor operating in the premixed mode of operation over a wider load range of the turbine.

BEST MODE FOR CARRYING OUT THE INVENTION

Figure 1:
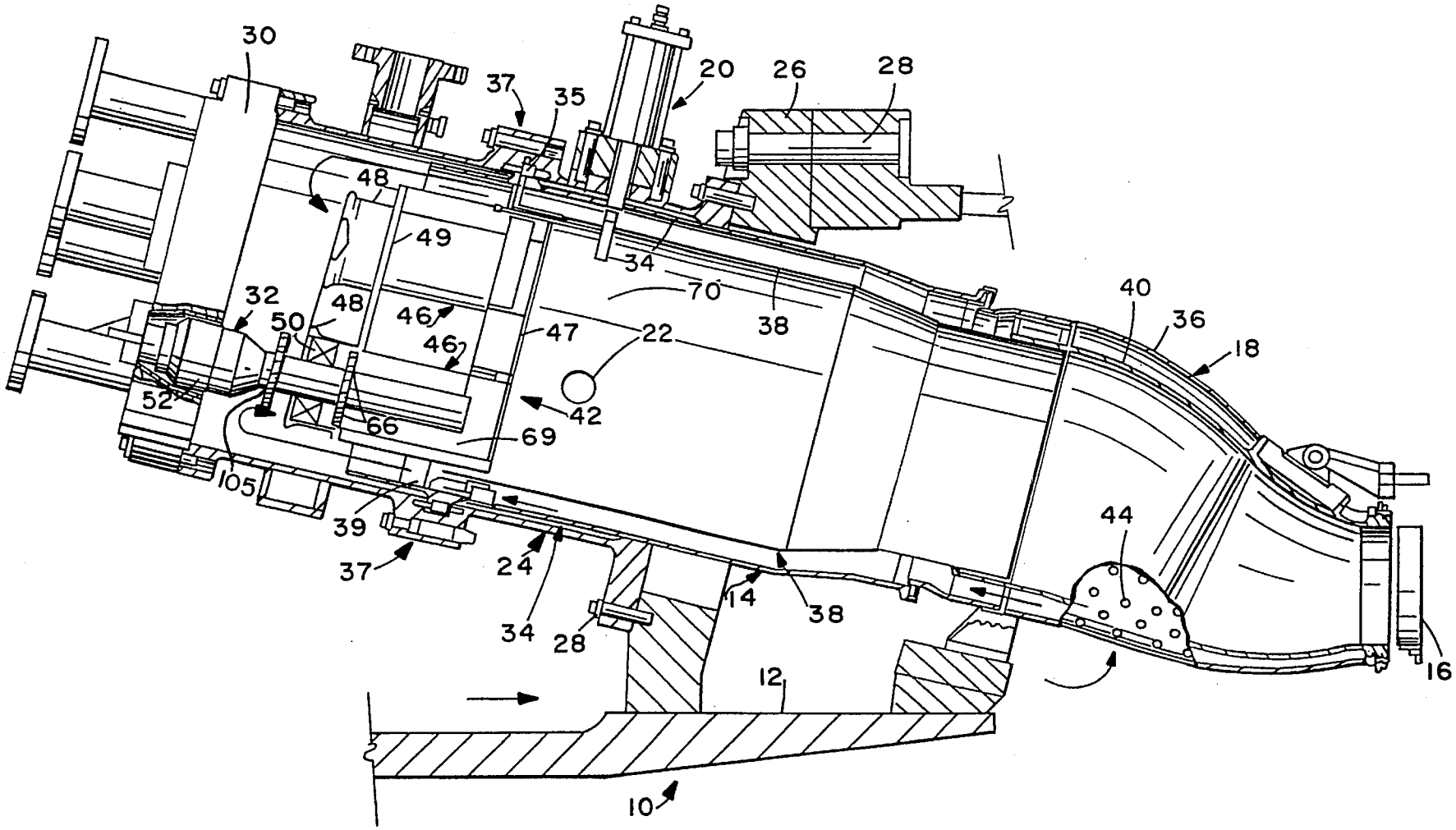
FIG. 1 is a cross-sectional view through one of the combustors of a turbine in accordance with an exemplary embodiment of the present invention.

With reference to FIG. 1, the gas turbine 10 includes a compressor 12 (partially shown), a plurality of combustors 14 (one shown), and a turbine represented here by a single blade 16. Although not specifically shown, the turbine is drivingly connected to the compressor 12 along a common axis. The compressor 12 pressurizes inlet air which is then reverse flowed to the combustor 14 where it is used to cool the combustor and to provide air to the combustion process.

As noted above, the gas turbine includes a plurality of combustors 14 located about the periphery of the gas turbine. A double-walled transition duct 18 connects the outlet end of each combustor with the inlet end of the turbine to deliver the hot products of combustion to the turbine. Ignition is achieved in the various combustors 14 by means of spark plug 20 in conjunction with cross fire tubes 22 (one shown) in the usual manner.

Each combustor 14 includes a substantially cylindrical combustion casing 24 which is secured at an open forward end to the turbine casing 26 by means of bolts 28. The rearward end of the combustion casing is closed by an end cover assembly 30 which includes conventional supply tubes, manifolds and associated valves, etc., for feeding gas, liquid fuel and air (and water if desired) to the combustor as described in greater detail below. The end cover assembly 30 receives a plurality (for example, five) of fuel nozzle assemblies 32 (only one shown for purposes of convenience and clarity) arranged in a symmetric circular array about a longitudinal axis of the combustor (see FIG. 5).

Within the combustor casing 24, there is mounted, in substantially concentric relation thereto, a substantially cylindrical flow sleeve 34 which connects at its forward end to the outer wall 36 of the double-walled transition duct 18. The flow sleeve 34 is connected at its rearward end by means of a radial flange 35 to the combustor casing 24 at a butt joint 37 where fore and aft sections of the combustor casing 24 are joined.

Within the flow sleeve 34, there is a concentrically arranged combustion liner 38 which is connected at its forward end with the is inner wall 40 of the transition duct 18. The rearward end of the combustion liner 38 is supported by a combustion liner cap assembly 42 which is, in turn, supported within the combustor casing by a plurality of struts 39 and associated mounting flange assembly 41 (best seen in FIG. 5). It will be appreciated that the outer wall 36 of the transition duct 18, as well as that portion of flow sleeve 34 extending forward of the location where the combustion casing 24 is bolted to the turbine casing (by bolts 28) are formed with an array of apertures 44 over their respective peripheral surfaces to permit air to reverse flow from the compressor 12 through the apertures 44 into the annular space between the flow sleeve 34 and the liner 38 toward the upstream or rearward end of the combustor (as indicated by the flow arrows shown in FIG. 1).

Figure 5:
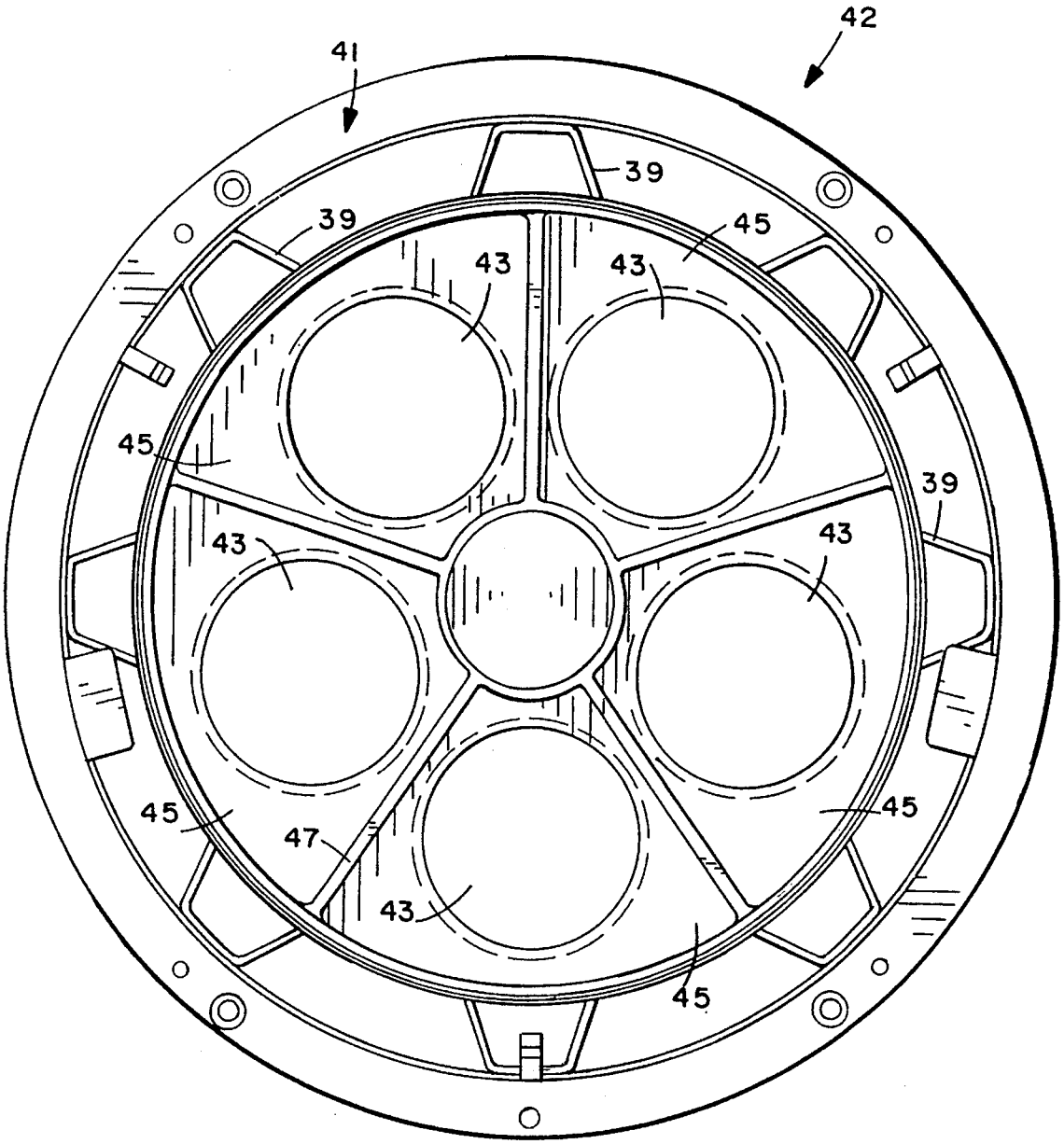
FIG. 5 is a front end view of the combustion liner cap assembly.

The combustion liner cap assembly 42 supports a plurality of premix tubes 46, one for each fuel nozzle assembly 32. More specifically, each premix tube 46 is supported within the combustion liner cap assembly 42 at its forward and rearward ends by front and rear plates 47, 49, respectively, each provided with openings aligned with the open-ended premix tubes 46. This arrangement is best seen in FIG. 5, with openings 43 shown in the front plate 47. The front plate 47 (an impingement plate provided with an array of cooling apertures) may be shielded from the thermal radiation of the combustor flame by shield plates 45.

The rear plate 49 mounts a plurality of rearwardly extending floating collars 48 (one for each premix tube 46, arranged in substantial alignment with the openings in the rear plate), each of which supports an air swirler 50 in surrounding relation to a radially outermost tube of the nozzle assembly 32. The arrangement is such that air flowing in the annular space between the liner 38 and flow sleeve 34 is forced to again reverse direction in the rearward end of the combustor (between the end cap assembly 30 and sleeve cap assembly 44) and to flow through the swirlers 50 and premix tubes 46 before entering the burning zone within the liner 38, downstream of the premix tubes 46.

Figure 2:
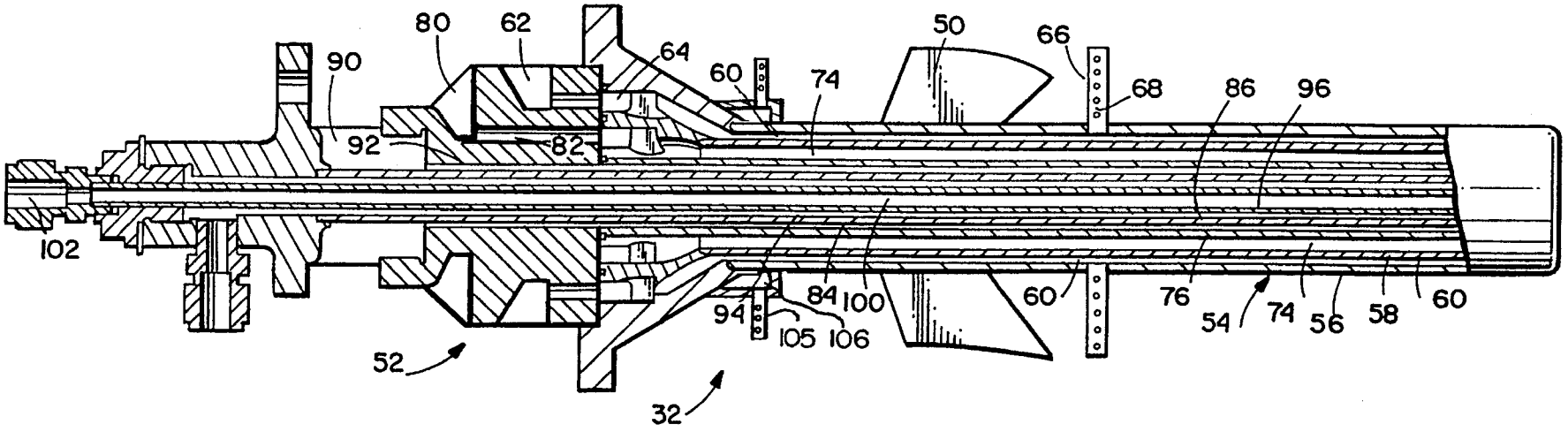
FIG. 2 is a sectional view of a fuel injection nozzle thereof.
Figure 3:
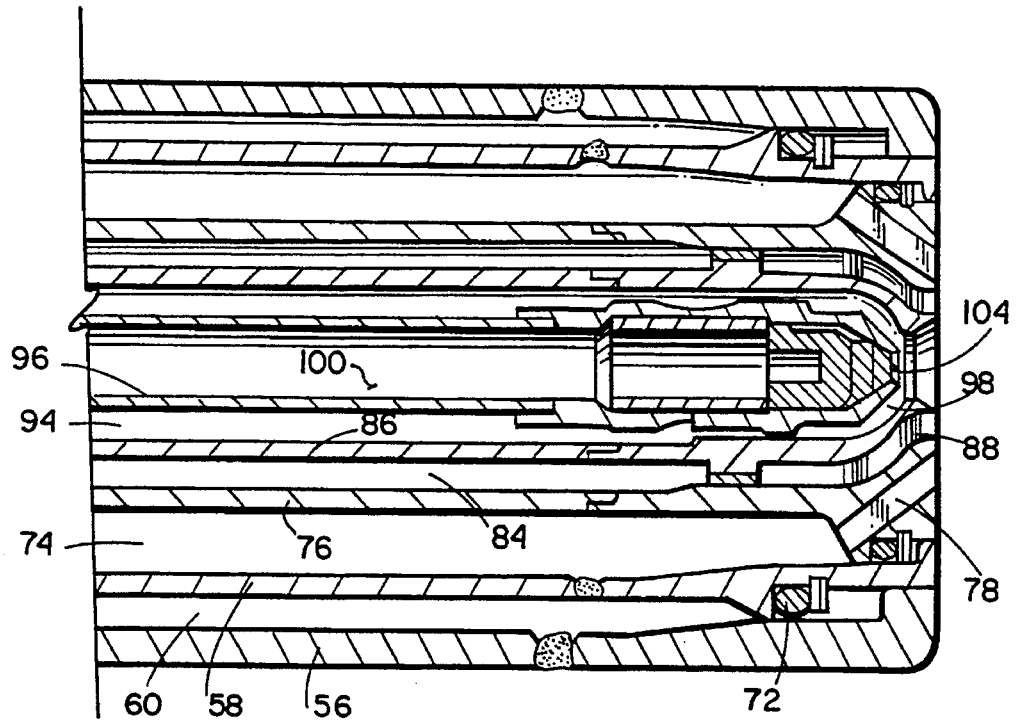
FIG. 3 is an enlarged end detail of the forward end of the nozzle.
Figure 4:
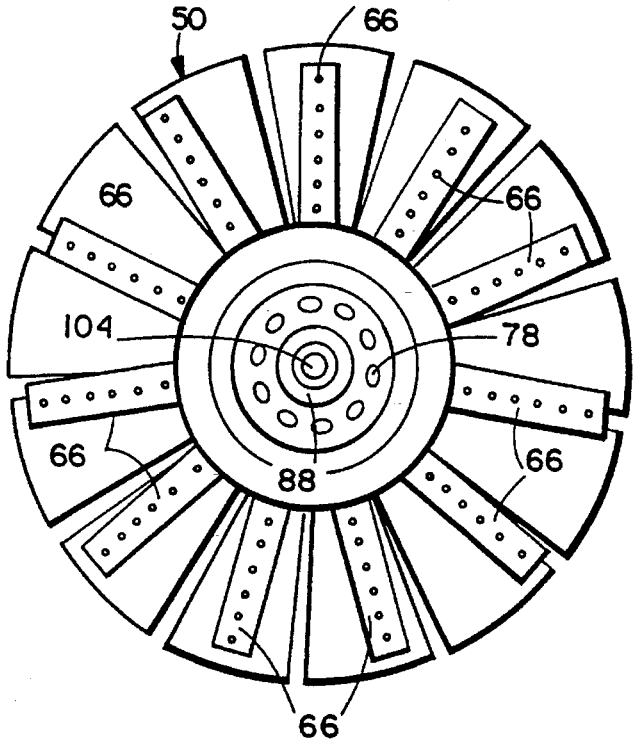
FIG. 4 is a front end view of a nozzle.

Turning to FIGS. 2, 3 and 4, each fuel nozzle assembly 32 includes a rearward supply section 52 with inlets for receiving liquid fuel, atomizing air, diffusion gas fuel and premix gas fuel, and with suitable connecting passages for supplying each of the above mentioned fluids to a respective passage in a forward delivery section 54 of the fuel nozzle assembly, as described below.

The forward delivery section 54 of the fuel nozzle assembly is comprised of a series of concentric tubes 56, 58. The tubes 56 and 58 provide a premix gas passage 60 which receives premix gas fuel from an inlet 62 connected to passage 60 by means of conduit 64. The premix gas passage 60 also communicates with a plurality (for example, eleven) radial fuel injectors 66, each of which is provided with a plurality of fuel injection ports or holes 68 for discharging gas fuel into a premix zone 69 located within the premix tube 46. The injected fuel mixes with air reverse flowed from the compressor 12, and swirled by means of the annular swirler 50 surrounding the fuel nozzle assembly upstream of the radial injectors 66.

The premix passage 60 is sealed by an O-ring 72 at the forward or discharge end of the fuel nozzle assembly, so that premix fuel may exit only via the radial fuel injectors 66.

The next adjacent passage 74 is formed between concentric tubes 58 and 76, and supplies diffusion gas to the burning zone 70 of the combustor via orifice 78 at the forwardmost end of the fuel nozzle assembly 32. The forwardmost or discharge end of the nozzle is located within the premix tube 46, but relatively close to the forward end thereof. The diffusion gas passage 74 receives diffusion gas from an inlet 80 via conduit 82.

A third passage 84 is defined between concentric tubes 76 and 86 and supplies atomizing air to the burning zone 70 of the combustor via orifice 88 where it then mixes with diffusion fuel exiting the orifice 78. The atomizing air is supplied to passage 84 from an inlet 90 via conduit 92.

The fuel nozzle assembly 32 is also provided with a further passage 94 for (optionally) supplying water to the burning zone to effect $NO_x$ reductions in a manner understood by those skilled in the art. The water passage 94 is defined between the tube 86 and adjacent concentric tube 96. Water exits the nozzle via an orifice 98, radially inward of the atomizing air orifice 88.

Tube 96, the innermost of the series of concentric tubes forming the fuel injector nozzle, itself forms a central passage 100 for liquid fuel which enters the passage by means of inlet 102. The liquid fuel exits the nozzle by means of a discharge orifice 104 in the center of the nozzle. It will be understood by those skilled in the art that the liquid fuel capability is provided as a back-up system, and passage 100 is normally purged with compressor discharge air while the turbine is in its normal gas fuel mode.

The combustor, as described above, is fully set forth in U.S. Pat. No. 5,259,184 and its operation is therein described as well. In that described operation, diffusion gas fuel is fed through inlet 80, conduit 82 and passage 74 for discharge via orifice 78 into the burning zone 70, where it mixes with atomizing air, is ignited by sparkplug 20 and burned in the zone 70 within the liner 38 during a diffusion mode of operation. At higher loads, premix gas fuel is supplied the passages 60 via inlet 62 and conduit 64 for discharge through orifices 68 in radial injector 66. The premix fuel mixes with air, entering the premix tube 46 by means of swirlers 50, the mixture igniting in burning zone 70 in liner 38 by the preexisting flame from the diffusion mode of operation. During premix operation, the fuel to the diffusion passage 74 is shut down.

As indicated previously, certain tendencies toward instability and high amplitude combustion noise are exhibited during transition between the diffusion and premixed modes of operation. The present invention stages the fuel to the fuel nozzles in a manner which will now be described to minimize or eliminate those tendencies, as well as to enable operation in a premixed mode over a wider load range of the turbine than previously believed possible.

Figure 6:
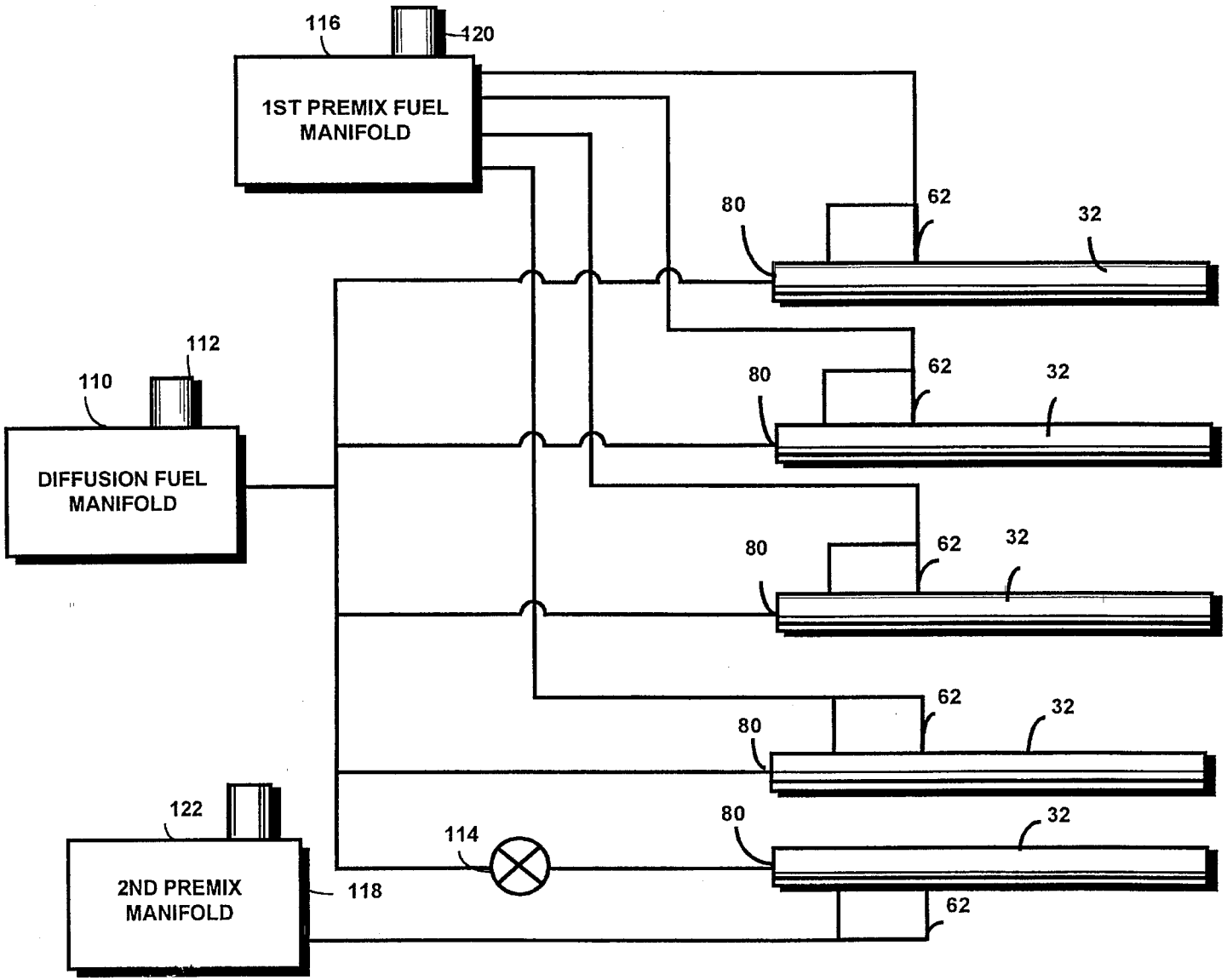
FIG. 6 is a schematic illustration of the arrangement of the nozzles with the premix and diffusion fuel supply manifolds.

Referring now to FIG. 6, there is schematically represented a diffusion fuel manifold 110 for supplying diffusion fuel to the diffusion fuel inlet passages 80 of the various nozzles 32. A valve 112 may be located in the manifold 110 to open and close the supply of fuel from manifold 110 to the nozzles. Additionally, a valve 114 may be disposed in the diffusion fuel line to one or more of the diffusion fuel nozzles. Further, in FIG. 6, there is illustrated a first premix manifold 116 for supplying premix fuel to certain of the nozzles and a second premix manifold 118 for supplying fuel to the remaining one or more nozzles. Each downstream premix manifold has a valve 120 and 122 movable between open and closed positions to supply fuel or not to the connected nozzles. Individual valves can be located in the individual supply lines as desirable and it will be appreciated that the manifold valves, as well as any valves disposed in the fuel supply lines, will be operated in a conventional manner.

To stage the fuel during the operation of the combustor, at start-up, the valve 112 is opened to supply diffusion fuel from manifold 110 to each of the nozzles 32 or to a lesser number of the nozzles, for example, by closing valve 114, or by omitting a diffusion fuel supply line entirely to one or more of the nozzles. With the turbine combustor now operating in the diffusion mode with all or less than all of the nozzles supplied with the diffusion fuel, load is applied to the turbine. In one preferred form of operation, the diffusion fuel is supplied only to four of the five nozzles, as illustrated, and the fifth nozzle is totally disconnected from the diffusion fuel manifold and supplies only air to the fifth nozzle during start-up. As load is applied, for example, within a range of 30 to 50% of full power, the combustor is transitioned from operation in a diffusion mode to operation in a premixed mode. At the beginning of the transition, the second premix manifold valve 122 is opened to supply premix fuel to the fifth nozzle whereby diffusion mode operation continues, but with the fifth nozzle providing premixed fuel/air to the single combustion zone. As the load increases, the supply of diffusion fuel to the remaining four nozzles is cut off and the valve 120 of the first premix manifold 116 is opened to supply premix fuel to the four nozzles. At this stage (during diffusion operation prior to transition and during premixed operation after transition), it will be appreciated that the nozzles are unequally supplied with fuel. Preferably, the fifth nozzle has a greater fuel/air ratio and therefore runs rich and stable. This also stabilizes the other four nozzles when transitioned from the diffusion to premixed mode and allows entry into the premixed mode at a lower turbine load than would otherwise be the case. This unequal fueling of the nozzles prevents severe combustion dynamics from occurring during the transition and increases the stability of the combustion process.

Further, near full load, i.e., 90%, the fuel split between the premix nozzles is modulated to provide substantially equal fuel flow to the premix nozzles. Thus, the ability to vary the fuel split enables utilization of premix nozzles which are designed for low $NO_x$ and CO emissions performance, and which exhibit desirable stability and combustion dynamics characteristics. Also note that the increase in fuel as a percentage of total fuel supplied to the fifth nozzle prior to and during transition and at higher loadings enables the fifth nozzle to have a higher local equivalence ratio than at the exit of the other four nozzles, resulting in a more stable flame at the fifth nozzle. Note further that the fifth nozzle creates an asymmetric heat release at the head end of the combustor which inhibits the onset of strong dynamic pressure oscillations in the combustor.

It will be appreciated that the number of nozzles previously referred to, i.e., five nozzles, is exemplary only and that a greater or lesser number of nozzles may be utilized. It will also be appreciated that the manner in which the fuel is split among the various nozzles need not be through manifolds but could be accomplished through individual valves in each of the fuel supply lines to the various nozzles.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of operating a combustor for a gas turbine wherein the combustor has a plurality of fuel nozzles arranged about an axis of the combustor, comprising the step of variably controlling the flow of fuel through the nozzles to a combustion zone downstream of said nozzles to provide an asymmetric flow of fuel across the combustor in a plane normal to said axis and during transition between a diffusion flow mode of operation and a premixed mode of operation.

2. The method according to claim 1 including the further step of providing the asymmetric flow of fuel during a diffusion mode of operation of the turbine preceding said transition.

3. The method according to claim 1 including the further step of providing the asymmetric flow of fuel during a premixed mode of operation succeeding said transition.

4. The method according to claim 1 wherein the nozzles are arranged in a symmetrical annular array about said axis of the combustor, and including the further step of providing the asymmetric flow of fuel by supplying a greater percentage of the total fuel flow through the combustor through one of said nozzles than any other of said nozzles.

5. The method according to claim 1 including, simultaneously during said transition, providing diffusion fuel through a first predetermined number of said nozzles less than the total number of said plurality of nozzles to the combustion zone and providing premixed fuel/air through remaining nozzles of said plurality of nozzles.

6. A method of operating a combustor for a gas turbine wherein the combustor has a plurality of fuel nozzles in an annular array about an axis of the combustor comprising the step of providing an asymmetric flow of fuel across the combustor in a plane normal to said axis to a combustion zone downstream of said nozzles and during transition between a diffusion flow mode of operation and a premixed mode of operation.

7. The method according to claim 6 including the further step of providing the asymmetric flow of fuel during a diffusion mode of operation succeeding said transition.

8. The method according to claim 6 including the further step of providing the asymmetric flow of fuel during a premixed mode of operation succeeding said transition.

9. The method according to claim 6 including, simultaneously during said transition, providing diffusion fuel through a first predetermined number of said nozzles less than the total number of said plurality of nozzles to the combustion zone and providing premixed fuel/air through remaining nozzles of said plurality of nozzles.

10. A method of operating a combustor for a gas turbine wherein the combustor has a plurality of nozzles in an array about an axis of said combustor comprising the steps of:

flowing fuel through at least certain of said plurality of nozzles operating in a diffusion mode to a single combustion zone downstream of said nozzles; and during transition from a diffusion mode of operation to a premixed mode of operation, flowing fuel to the combustion zone through at least one of said plurality of nozzles operating in a premixed mode while maintaining said certain nozzles operating in the diffusion mode and variably controlling the flow of fuel through said nozzles to provide an asymmetric flow of fuel across the combustor in a plane normal to said axis to the combustion zone downstream of said nozzles.

11. The method according to claim 10 including the step of providing the asymmetric flow of fuel during said transition.

12. The method according to claim 10 including the step of, subsequent to said transition, operating all nozzles in the premixed mode.

13. The method according to claim 10 wherein said nozzles are in an annular array about an axis of said combustor, and including the further steps of subsequent to said transition, operating all nozzles in the premixed mode, variably controlling the flow of fuel through all of said nozzles to provide an asymmetric flow of fuel across the combustor in a plane normal to said axis during operation of all nozzles in the premixed mode.

14. The method according to claim 10 including the further step of providing an asymmetric flow of fuel across the combustor to a combustion zone downstream of said nozzles.

15. The method according to claim 10 including flowing fuel through said nozzles to provide a fuel/air ratio through one nozzle different from a fuel/air ratio through another of said nozzles.

16. The method according to claim 15 wherein said fuel/air ratio through said one nozzle is greater than the fuel/air ratio through said another nozzle.

* * * * *